US005156760A

United States Patent [19]

Marchese et al.

[11] Patent Number: 5,156,760

[45] Date of Patent: Oct. 20, 1992

[54] SURFACE CLEANING COMPOSITIONS

[75] Inventors: Frank P. Marchese, Bronxville; Joseph S. Engenito, Jr., Elmont, both of N.Y.

[73] Assignee: Marchemco, Inc., White Plains, N.Y.

[21] Appl. No.: 542,536

[22] Filed: Jun. 25, 1990

[51] Int. Cl.[5] ..... C11D 7/26; C11D 3/43

[52] U.S. Cl. ..... 252/171; 252/173; 252/162; 252/170; 252/DIG. 14; 252/DIG. 1; 252/174.21; 252/158

[58] Field of Search ..... 252/158, 162, 173, 174.21, 252/DIG. 8, DIG. 1, 170, DIG. 14, 171; 106/311

[56] References Cited

U.S. PATENT DOCUMENTS

| | | | |
|---|---|---|---|
| 3,915,880 | 10/1975 | Sepulveda | 252/112 |
| 4,145,226 | 3/1979 | Neuhaus | 106/311 |
| 4,414,128 | 11/1983 | Goffinet | 252/162 |
| 4,767,563 | 8/1988 | de Buzzaccarini | 252/135 |
| 4,787,984 | 11/1988 | Hutchings et al. | 252/174.11 |
| 4,790,951 | 12/1988 | Frieser et al. | 252/162 |
| 4,797,231 | 1/1989 | Schumann et al. | 252/162 |

FOREIGN PATENT DOCUMENTS

| | | |
|---|---|---|
| 1120820 | 3/1982 | Canada . |
| 2564104 | 11/1985 | France . |
| 2564105 | 11/1985 | France . |
| 51-792 | 3/1985 | Japan . |
| 51-796 | 3/1985 | Japan . |

OTHER PUBLICATIONS

Hercules Pine Oil Formulary Jul. 24, 1963, 57 pages.

McCutcheon's Detergents & Emulsifiers 1978 Annual p. 74.

Mauley's Condensed Chemical Dictionary 11th ed. 1987, pp. 1015, 1118 & 1128.

*Primary Examiner*—Prince Willis, Jr.

*Assistant Examiner*—James Silbermann

[57] ABSTRACT

A cleansing composition for the removal of ink and glaze from blanket rollers and cylinders of printing presses comprises terpene alcohol and a non-ionic surfactant. Cleansing compositions are also provided comprising tall oil (as the potassium salt thereof), pine oil, isopropanol and a non-ionic surfactant, preferably polyoxyethylene 4 lauryl ether.

8 Claims, No Drawings

SURFACE CLEANING COMPOSITIONS

FIELD OF THE INVENTION

This invention relates generally to cleansing compositions and is particularly related to cleansing compositions for diverse applications such as ink and glaze removal from print rollers and blanket cylinders, removal of undesirable surface markings from hard surfaces such as floor tiles, terrazzo, bricks, ceramics and the like. More particularly, the present invention relates to such cleansing compositions which contain pine oil, tall oil (potassium salt) and certain non-ionic surfactant.

BACKGROUND OF THE INVENTION

In printing press operations, whether in offset printing or letter press printing, the various blanket rollers and cylinders of the press are covered with excess ink and lint at the conclusion of the printing operation. This excess ink must be removed and the rollers and cylinders cleaned in order to prepare the press for further printing. Conventionally, naphtha or similar cleaning fluids have been used to clean the rollers. However, such cleaning fluids have not been entirely satisfactory because of the large quantities of naphtha required to clean the rollers. Besides, these fluids are pollutants and present serious health hazards, particularly since they must be used in relatively large amounts. Moreover, these fluids are ineffective for the removal of glaze and lint with which the rollers are coated as a result of the printing operations thus requiring a separate glaze removing fluid for complete and effective cleaning of the press and its rollers.

Cleansing compositions have also been employed for the removal of undesirable stains and markings from various surfaces such as floor tiles, walls, sinks, outer surfaces of machineries, including printing presses, terrazzo, bricks, ceramics and the surfaces of a host of other similar products. Frequently, it is desired or necessary to restore the original finish or appearance of such surfaces and the cleansing composition must be effective for such restoration purposes. One cleansing composition for the removal of stains and undesirable markings from hard surfaces is disclosed in U.S. Pat. No. 3,915,880. The compositions disclosed in said patent comprises pine oil, ammonia and a bleaching agent, the balance being primarily water.

An ink removing composition is disclosed in U.S. Pat. No. 4,145,226 which comprises a glycol ether, isopropyl acetate and a hydrocarbon-soluble liquid surfactant. The compositions disclosed in this patent is used for ink removal from natural and synthetic fabrics.

U.S. Pat. No. 4,667,597 discloses a printing press blanket cleaner which removes ink, dust or lint from blanket cylinders of an off set printing press. The cleaner described in this patent is a mechanical cleaner involving the use of a fluid cylinder which periodically urges a brush against the blanket cylinder and retracts the brush from the cylinder to effect the removal of ink, dust or lint from the blanket cylinders. So far as it is known, there is no cleansing composition which can be effectively used for both ink and glaze removal from blanket cylinders and rollers in a printing press operation. Moreover, naphtha and other hydrocarbon fluids used for ink removal present potential danger to their volatility inherent flammability and adverse environmental impact.

Accordingly, it is an object of this invention to provide a cleansing composition for use in the removal of ink and glaze from the blanket rollers of a printing press.

It is a further object of this invention to provide a cleansing composition which is useful for the removal of undesirable stains and surface markings from various surfaces, including hard surfaces such as floor tiles, terrazzo, bricks, ceramics, sinks and the like.

It is still another object of this invention to provide such cleansing compositions which are even effective by a simple one step application.

The foregoing and other objects and features of this invention will be further described in the ensuing detailed description.

SUMMARY OF THE INVENTION

In accordance with this invention a cleansing composition comprises pine oil and a non-ionic surfactant, and may further include tall oil (as the potassium salt thereof). This composition is particularly useful as ink and glaze removal from blanket rollers and cylinders of an offset printing press. Other compositions useful for various purposes including the removal of undesirable surface markings, or floor and tile wax polish comprises tall oil (as the potassium salt thereof), pine oil, isopropanol and a non-ionic surfactant. These compositions may further include a brightener and a fragrance.

DETAILED DESCRIPTION OF THE INVENTION

In one embodiment of the present invention which is particularly useful for cleaning and removing ink and glaze from blanket rollers of a printing press, the cleansing composition comprises pine oil and a non-ionic surfactant, and may further include tall oil (as potassium salt).

Pine oil is commercially available from wood and consists primarily of $\alpha$-terpineol (a particular terpene alcohol), other terpene alcohols and dipentene, and may also contain minor amounts of inert ingredients. It has been found that variations in the amounts of terpene alcohol and dipentene effects the cleansing efficiency of the composition. Thus, it has been found that particularly effective cleansing compositions are those in which the pine oil has a terpene alcohol to dipentene ratio of at least about 7, preferably from about 8 to about 50.

Various commercial grades of pine oil are available from Union Camp Corporation, Jacksonville, Florida. These are sold under the trade name UNIPINE and include UNIPINE-80, UNIPINE-85 and UNIPINE-90. In addition to these, pine oils include TERPINEOL-900. All of these are known by their chemical name p-MENTH-1-EN-8-OL. They all basically contain the same ingredients, differing only in the relative amounts of the ingredients, i.e., terpene alcohol and dipentene.

It has also been found that TERPINEOL-900 and UNIPINE-90 are particularly effective in formulations used for cleaning printing chemicals, while UNIPINE-80 and UNIPINE-85 are useful for removing floor polish and surface markings.

In general, the cleaning compositions broadly useful in the practice of the present invention comprise from about 5 to about 90 weight percent terpene alcohol, from about 3 to about 18 weight percent of non-ionic surfactant, from about 0 to about 25 weight percent isopropanol, from about 0 to about 25 weight percent tall oil, the balance being water as is needed.

A preferred cleansing composition useful in the embodiment of the invention as roller and blanket cleaner comprises from about 5-90 weight percent terpene alcohol, from about 3 to about 18 weight percent a non-ionic surfactant to be hereinafter described and, optionally, the balance being water. Terpineol 900 is a particularly preferred pine oil since it is more effective and is practically odorless. It contains approximately 91.5 weight percent α-terpineol, 6.0 weight percent terpene alcohol and 2.5 weight percent dipentene.

The cleansing composition used as a surface cleaner contains a small amount of tall oil in the form of its potassium salt. Thus, between about 1 to about 25 weight percent of tall oil may be added to the cleansing composition in order to enhance its emulsifying and cleansing actions. Also, if desired, all or part of the terpineol may be replaced with other grades of pine oil such as UNIPINE-80, UNIPINE-85 and/or UNIPINE-90.

The non-ionic surfactant which is particularly well suited for the cleansing compositions of this invention is polyoxyethylene 4 lauryl ether, known by its CTFA (Cosmetic Toiletry and Fragrance Association) name Laureth-4. This non-ionic surfactant is available from ICI America, Inc., Wilmington, Del., and is sold under the trade name BRIJ-30. Other non-ionic surfactants may be employed for this purpose. These surfactants are described in copending, commonly assigned application Ser. No. 432,386 filed Nov. 3, 1989, the disclosure of which is fully incorporated herein by reference.

In another aspect of this invention relating to cleansing compositions useful as floor brightener and surface cleaner and multi-surface cleaner (ink remover), the composition may comprise tall oil (as potassium salt) containing from about 4 to about 45 weight percent rosin, isopropanol, pine oil and said non-ionic surfactant. The composition may optionally contain a brightener.

The amount of tall oil may vary from about 1 to about 25 weight percent, preferably from about 6 to about 15 weight percent of the composition.

Isopropanol may be used in an amount varying between about and about 0 to about 10 weight percent, preferably between about 4 and about 6 weight percent.

Such compositions also contain from about 3 to about 6 weight percent of non-ionic surfactant is used selected from the group consisting of polyoxyethylene lauryl ethers, from about 4 to about 6 weight percent isopropanol, from about 6 to about 15 weight percent tall oil, the balance being water. As in the case of the cleansing compositions used for blanket rollers, other non-ionic surfactants may be used as hereinbefore described.

In each composition, the pH of the mixture is adjusted by the addition of phosphoric acid or other acids. For compositions useful as floor polish and multi-surface cleansers the pH is optimally about 10.

Where a fragrance is added, the amount is generally small, usually of the order of about 1 to 4 weight percent.

The following examples illustrate various formulations useful for different applications in accordance with the present invention.

| Ingredients | Wt. % | | | |
|---|---|---|---|---|
| | A | B | C | D |
| Pine Oil 900[1] | 76.00 | 55.00 | 86.00 | 54.00 |
| Water | 15.00 | 36.00 | 10.00 | 41.00 |
| Laureth-4[2] | 8.00 | 8.00 | 3.00 | 4.00 |
| Fragrance (optional) | 1.00 | 1.00 | 1.00 | 1.00 |

Example 1
Printing Chemicals
Roller and Blanket Wash

-continued

Example 2
Floor Brightener and Surface Marks Remover

| | |
|---|---|
| Tall oil (as potassium salt)[3] | 7.35 |
| Isopropanol | 5.73 |
| Laureth-4 | 3.28 |
| Pine Oil[4] | 8.59 |
| Alcarat[5] (Brighteners) | 0.10 |
| Lemon Fragrance | 0.35 |
| Water | 74.00 |
| Phosphoric acid | 0.60 |

Example 3
Multi-Surface Cleaner

| | |
|---|---|
| Tall oil (a potassium salt) | 7.35 |
| Isopropanol | 5.73 |
| Laureth-4 | 3.28 |
| Pine Oil 85 | 8.59 |
| Fragrance | 0.35 |
| Water | 74.70 |

[1]Obtained from Union Camp Corporation, Jacksonville, Florida.
[2]Obtained from ICI America, Inc., Wilmington, Delaware
[3]contains 40% rosin
[4]Pine oil 85 was used but could use other grades such as Unipine90 or 900.
[5]Obtained from Sandoz

EXAMPLE 3

Multi-Surface Cleaner

In preparing the roller and blanket wash, or the floor polish, water, tall oil (as potassium salt obtained by adding KOH to tall oil) and isopropanol were mixed together in a laboratory blender at ambient conditions to obtain a homogenous mixture. A separately prepared mixture of Laureth 4 and a brightener was then added to the mixture followed by pine oil, with continued agitation. Thereafter, phosphoric acid was added to the resulting formulation to obtain the desired pH of about 9.3.

The multi-surface cleaner is prepared much in the same way except that a brightener is not included in the formulation.

While the present invention has been described with a certain degree of particularity, it is understood that some changes in the compositions involving substitution of equivalent ingredients may be made therein. Such changes are obvious from the description herein and fall within the contemplation of this invention.

What is claimed is:

1. A cleaning composition comprising from about 5 to about 90 weight percent pine oil, from about 3 to about 6 weight percent of polyoxyethylene 4 lauryl ether, from about 4 to about 10 weight percent isopropanol, from about 1 to about 25 weight percent tall oil, the balance being water.

2. A cleaning composition as in claim 1 wherein said tall oil contains from about 4 to about 45 weight percent rosin.

3. A cleaning composition as in claim 1, wherein said pine oil contains terpene alcohol and dipentene where the ratio of terpene alcohol to dipentene is about at least 7:1.

4. A cleaning composition as in claim 2, wherein said pine oil contains terpene alcohol and dipentene where the ratio of terpene alcohol to dipentene is about at least 7:1.

5. A composition useful as a surface cleaner and floor brightener comprising from about 5 to about 90 weight percent pine oil, from about 3 to about 6 weight percent polyoxyethylene 4 lauryl ether, from about 4 to about 6 weight percent isopropanol, from about 6 to about 15 weight percent tall oil, the balance being water.

6. A composition as in claim 5, wherein said pine oil contains terpene alcohol and dipentene where the ratio of terpene alcohol to dipentene is about at least 7:1.

7. A composition as in claim 5 wherein said tall oil contains from about 4 to about 45 weight percent rosin.

8. A composition as in claim 6 wherein said tall oil contains from about 4 to about 45 weight percent rosin.

* * * * *